US012553162B2

(12) United States Patent
Wörnle et al.

(10) Patent No.: US 12,553,162 B2
(45) Date of Patent: Feb. 17, 2026

(54) KNITTING SYSTEM AND NEEDLE FOR KNITTING MACHINES

(71) Applicants: Groz-Beckert KG, Albstadt (DE); Santoni S.p.A., Brescia (IT)

(72) Inventors: Martin Wörnle, Mössingen (DE); Markus Settegast, Geislingen (DE)

(73) Assignees: GROZ-BECKERT KG, Albstadt (DE); SANTONI S.P.A, Brescia (IT)

( * ) Notice: Subject to any disclaimer, the term of this patent is extended or adjusted under 35 U.S.C. 154(b) by 0 days.

(21) Appl. No.: 18/034,426

(22) PCT Filed: Oct. 28, 2021

(86) PCT No.: PCT/EP2021/079909

§ 371 (c)(1),
(2) Date: Apr. 28, 2023

(87) PCT Pub. No.: WO2022/090356

PCT Pub. Date: May 5, 2022

(65) Prior Publication Data

US 2024/0352635 A1 Oct. 24, 2024

(30) Foreign Application Priority Data

Oct. 30, 2020 (DE) ..... 10 2020 128 660.0

(51) Int. Cl.
*D04B 35/04* (2006.01)
*D04B 15/10* (2006.01)
*D04B 15/14* (2006.01)

(52) U.S. Cl.
CPC ..... *D04B 35/04* (2013.01); *D04B 15/10* (2013.01); *D04B 15/14* (2013.01)

(58) Field of Classification Search
CPC ..... D04B 35/04; D04B 35/06; D04B 15/10; D04B 15/14
(Continued)

(56) References Cited

U.S. PATENT DOCUMENTS 664,808 A * 12/1900 Dodge ..... D04B 35/02 66/123
2,240,761 A * 5/1941 Cloutier ..... D04B 35/04 66/24
(Continued)

FOREIGN PATENT DOCUMENTS

DE 680319 C * 8/1939 ..... D04B 7/28
EP 0814186 B1 1/2002
(Continued)

OTHER PUBLICATIONS

International Search Report and Written Opinion for PCT/EP2021/079909, dated Jan. 25, 2022; 15 pages.
(Continued)

*Primary Examiner* — Aiying Zhao
(74) *Attorney, Agent, or Firm* — Fitch, Even, Tabin & Flannery LLP

(57) ABSTRACT

A knitting system 18 and a needle 1, which show greater stability and consume less power during the knitting process, include a bending portion 9 in which at least one recess 11 is arranged at at least one lateral surface 23 of the needle 1 and/or is formed in such a manner that a shaft offset S exists, in a peripheral direction U, between a working portion 10 of the needle 1 and a shank portion 8 of the needle 1.

15 Claims, 12 Drawing Sheets

(58) Field of Classification Search
USPC ..... 66/121
See application file for complete search history.

(56) References Cited

U.S. PATENT DOCUMENTS

| | | | | | |
|---|---|---|---|---|---|
| 2,622,421 | A * | 12/1952 | Minton | D04B 9/22 | 66/24 |
| 4,267,709 | A * | 5/1981 | Hittel | D04B 27/08 | 66/87 |
| 5,097,683 | A * | 3/1992 | Schuler | D04B 35/02 | 66/124 |
| 5,327,748 | A * | 7/1994 | Izumi | D04B 35/02 | 66/123 |
| 2012/0006064 | A1* | 1/2012 | Haug | D04B 35/02 | 66/123 |
| 2015/0128651 | A1* | 5/2015 | Lonati | D04B 15/10 | 66/57 |
| 2015/0128652 | A1 | 5/2015 | Jung | | |
| 2017/0029990 | A1* | 2/2017 | Sauter | D04B 35/04 | |
| 2017/0350047 | A1* | 12/2017 | Lonati | D04B 35/04 | |

FOREIGN PATENT DOCUMENTS

| | | | | |
|---|---|---|---|---|
| EP | 2758577 | B1 | 10/2020 | |
| EP | 3643822 | B1 | 6/2021 | |
| GB | 315055 | A * | 7/1929 | D04B 15/10 |
| GB | 1333568 | | 10/1973 | |
| TW | 200837236 | A | 9/2008 | |
| TW | 202030391 | A | 8/2020 | |
| WO | 2012055591 | A1 | 5/2012 | |
| WO | 2016097974 | A1 | 6/2016 | |

OTHER PUBLICATIONS

German Patent and Trademark Office; Office action in corresponding German Patent Application No. 10 2020 128 660.0, dated Sep. 27, 2021; 15 pages.

Taiwan Intellectual Property Office (the Taiwan Patent Authority), Taiwanese Office Action and Search Report in corresponding Taiwanese Patent Application No. 110140053, dated Feb. 14, 2025, 29 pages.

Government of the People's Republic of Bangladesh, Department of Patents, Industrial Designs & Trademarks, Ministry of Industries; Bangladesh Office Action in corresponding Patent Application No. 356/2021, dated Jul. 14, 2024; 1 page.

European Patent Office; European Office Action in corresponding Patent Application No. 21 801 891.9-1017, dated Mar. 13, 2024, 8 pages.

European Patent Office; European Office Action in corresponding Patent Application No. 21 801 891.9-1017, dated Aug. 21, 2024; 4 pages.

National Intellectual Property Administration, P. R. China, Chinese Search Report in corresponding Chinese Patent Application No. 202180073290.0, dated Apr. 22, 2025; 3 pages.

China National Intellectual Property Administration, First Office Action in corresponding Chinese Patent Application No. 202180073290.0, dated Apr. 22, 2025; 8 pages.

Japanese Patent Office, Office Action in corresponding Japanese Patent Application No. JP2023526397A, dated Aug. 21, 2025.

* cited by examiner

KNITTING SYSTEM AND NEEDLE FOR KNITTING MACHINES

CROSS REFERENCE TO RELATED APPLICATIONS

This patent application is the national phase of PCT/EP2021/079909, filed Oct. 28, 2021, which claims the benefit of German Patent Application No. 10 2020 128 660.0, filed Oct. 30, 2020.

TECHNICAL FIELD

A large variety of knitting systems and loop-forming needles has been known for many years. In knitting machines, it is customary to use needle-guiding means comprising grooves in which loop-forming needles are guided and can be moved translatorially in the longitudinal direction of the grooves, which point in the working direction. In circular knitting machines, these needle-guiding means are typically knitting cylinders whose basic shape is cylindrical and whose cylinder axis points in the working direction. The grooves are then arranged on a cylindrical base surface of the knitting cylinder. In flat knitting machines, these needle-guiding means are typically needle beds having an essentially rectangular shape. The grooves in such needle beds are arranged on a planar base surface of the needle bed, said planar base surface pointing in an elevational direction. The elevational direction is at right angles to the working direction. Needle beds for flat knitting machines and knitting cylinders for circular knitting machines both constitute needle-guiding means. At their front end, the needles mostly have a loop-forming element—in most cases shaped as a hook—with which loops can be formed during the knitting process. The needle-guiding means has a plurality of grooves arranged side by side at a defined distance apart, said distance corresponding to the pitch, along a peripheral direction of the needle-guiding means. The peripheral direction in this context is at right angles to the working direction and to the elevational direction and extends along the base area of the needle-guiding means. In the case of a knitting cylinder, therefore, the peripheral direction always runs tangentially along the cylindrical base area of the knitting cylinder. Each needle comprises at least one drive butt via which it can be moved translatorially. For this purpose, the drive butts of the needles engage with a cam which has a curved profile in the peripheral direction of the needle-guiding means. Relative motion in peripheral direction between cam and needle-guiding means initiates translatory motion in working direction in the drive butts of the needles.

BACKGROUND

WO2012055591A1 shows a knitting machine having needles which, in a rearward shank portion, are guided in slide or guiding grooves and, in a forward working portion, are guided in loop-forming or verge grooves. The guiding grooves and verge grooves are arranged on a knitting cylinder, wherein associated guiding and verge grooves are mutually offset in the peripheral direction of the knitting cylinder. Loop-forming needles, each of which is guided in its own guiding groove and its own verge groove, are able to compensate this offset by means of elastic bending. In this way, an originally straight needle can be guided both in a guiding groove and in a verge groove which is offset, in peripheral direction, relative to said guiding groove. However, known loop-forming needles with high needle pitches—i.e. needles with a large shank width—are not designed for such loads. They therefore have a shorter service life and consume more power than is usual for loop-forming needles.

SUMMARY

Based on the prior art, one aim of the invention is therefore to devise a knitting system and a needle which show greater stability, are less prone to wear and require less power than previously known knitting systems and needles.

A knitting system features a needle-guiding means with a base surface pointing in an elevational direction, as well as at least one guiding groove which is arranged on the base surface of the needle-guiding means and extends substantially in working direction, wherein the working direction is at right angles to the elevational direction. At least one verge groove is arranged on the base surface of the needle-guiding means and is offset relative to the at least one guiding groove in peripheral direction and in working direction, said peripheral direction extending on the base surface of the needle-guiding means at right angles to the working direction and the elevational direction. At least one needle has, at its first end, which points in the positive working direction, a working portion incorporating a loop-forming element, and, at its second end, which points in the negative working direction, a shank portion, wherein, between said shank portion and said working portion, a bending portion is interposed in which the at least one needle has a bend with directional components in peripheral direction and in working direction. The working portion of the at least one needle is accommodated in a loop-forming groove and the shank portion of the at least one needle is accommodated in a guiding groove. It is advantageous if, in the bending portion of the at least one needle, at least one recess is arranged at at least one of its lateral surfaces pointing in peripheral or in elevational direction and/or the bending portion of the at least one needle is plastically formed in such a manner as to effect, in peripheral direction, a plastic shank offset between the working portion and the shank portion. The lateral surfaces here are the surfaces bounding the needle in peripheral direction and elevational direction. It is particularly advantageous if, in the bending portion of the at least one needle, at least two recesses are defined on at least one of its lateral surfaces pointing in peripheral direction or in elevational direction. For example, a plurality of recesses may be defined on the same lateral surface or one recess in each case on two lateral surfaces. It is just as possible for at least one recess to be defined on a lateral surface pointing in peripheral direction and at least one recess on a lateral surface pointing in elevational direction. The offset in peripheral direction, which exists between the verge groove and the guiding groove, is compensated by the needle by means of an elastic or plastic bend in its bending portion. Only in this way is it possible for the shank portion of a needle to be accommodated in a guiding groove and its working portion in a verge groove which is offset in peripheral direction relative to the guiding groove. The shank and working portions of a needle which has a recess in the bending portion can be configured with greater stability without necessitating higher bending forces for the bend in the bending portion. The needle height, for example, can be increased. On account of a prying effect, increased needle height in the shank portion enables driving forces, in particular, which are transmitted from the cam to the needle's drive butt, to be supported better in the guiding channel with lower supporting forces. Consequently, a needle of this kind not only shows greater stability but is also less prone to wear and requires less power. The guiding and verge grooves may be manufactured in different ways: for example, they may be introduced into the needle-guiding means by means of a machining method. It is also possible for the grooves—both guiding grooves and verge grooves—to be formed by walls inserted in the base surface, which project above the base surface and form grooves with neighbouring walls. The knitting system according to the invention may comprise guiding and verge grooves made by all production and construction methods previously known for this purpose. For the recess of the at least one needle, the following applies: it is advantageous to produce the recess by means of machining processes, such as grinding or milling, and/or forming processes, such as rolling, and/or parting processes, such as punching. A ground recess is particularly advantageous. Recesses produced by machining and forming methods, in particular ground recesses, can be made inexpensively and accurately. In the area of recesses, the needle's cross section is less than in surrounding areas.

Further advantages are obtained if at least one recess at a lateral surface pointing in peripheral direction has a recess depth of 10 μm to 100 μm, advantageously 30 μm to 70 μm, and/or at least one recess at a lateral surface pointing in elevational direction has a recess depth of 150 μm to 500 μm, advantageously 200 μm to 400 μm. The recess depth here is the depth to which the recess surface is sunk below the lateral surface on which the recess is defined Accordingly, in the case of a recess on a lateral surface pointing in peripheral direction, the recess surface also points in peripheral direction, and in the case of a recess on a lateral surface pointing in elevational direction, the recess surface also points in the elevational direction. If the recess were too deep, the needle would be weakened too much in the bending portion. This would then prevent exploitation of the advantages resulting, particularly in the shank portion, from the improved support of the needle on account of the driving forces. If, on the other hand, the recess is not deep enough, the stability of the needle in the shank portion and working portion cannot be sufficiently improved. The above-mentioned selection ranges have proved advantageous with customary needle widths of less than 0.6 mm and needle heights of less than 4 mm.

It is advantageous if the at least one recess extends, in an elevational direction which is at right angles to the working direction and the peripheral direction, over the entire needle height. A recess which extends over the entire needle height requires less complex production methods than a recess which only extends over part of the needle height. However, a recess which extends over a maximum of 90%, preferably a maximum of 80%, of the needle height is also advantageous. The bending properties of the needle can also be optimized with a recess which does not extend over the entire needle height.

It is advantageous if the at least one recess extends, in working direction, over the entire bending portion of the needle. The length of the bending portion in working direction is therefore the same as a recess length corresponding to the extension of the recess in working direction. Additional advantages are obtained if the at least one recess extends in working direction over a maximum of 80%, preferably a maximum of 50%, of the bending portion. The recess length is thus less than the length of the bending portion in working direction. In particular, the needle may also be bent at places where there is no recess. It is particularly advantageous if at least two recesses are defined on one of the needle's lateral surfaces pointing in the peripheral direction. A plurality of recesses is thus defined on the same lateral surface. It is also possible to define more than one recess in each case on a plurality of lateral surfaces. It is advantageous if the at least two recesses provided on a lateral surface are spaced from one another in working direction and/or elevational direction.

Of particular advantage is a knitting system in the case of which the at least one recess of the at least one needle, in an extended state and/or a retracted state, is completely outside the at least one verge groove and/or the at least one guiding groove. As already mentioned, the needles are translatorially movable in working direction in the verge and guiding grooves. The extended state of the needle in this case is the state in which the needle's loop-forming element projects furthest out of the verge groove in working direction. The retracted state of the needle is the state in which the loop-forming element projects the shortest distance out of the verge groove in working direction. Also in the extended and the retracted state, the working portion is accommodated in a verge groove and the shank portion in a guiding groove. The knitting system is configured in such a manner that a recess in the needle's bending portion does not engage either a verge groove or a guiding groove when the needle is in the extended or retracted state, thereby preventing the introduction of large amounts of dirt produced during knitting—for example fluff, abraded metal or dust—through the recess into the guiding and verge grooves. This reduces friction and is advantageous with regard to wear on the knitting system and to its power consumption.

It is furthermore advantageous if the at least one recess of the at least one needle in the retracted state is outside of the at least one guiding groove to an extent of at least 60%, preferably, however, 80% of the recess length, which corresponds to the extension of the recess in working direction, and/or if the at least one recess of the at least one needle in the extended state is outside of the at least one verge groove to an extent of at least 60%, preferably, however, 80% of the recess length. Depending on the requirements made on the knitting system and the knit goods to be produced, it may not be possible to configure the knitting system in such a way that the recess is also completely outside of the guiding groove in the retracted state and/or outside of the verge groove in the extended state. It is advantageous in this case if the recess is outside of the guiding and/or verge groove to an extent of at least 60% of the recess length, which corresponds to the extension of the recess in working direction. The amount of dirt introduced into the guiding groove and/or verge groove will not be enough in this case to prevent the described advantages of the knitting system according to the invention from being exploited.

Also to advantage is a knitting system comprising at least one drive butt, which is arranged in the shank portion of the at least one needle and projects above the surrounding shank portion in elevational direction, and a bending-portion clearance, which corresponds to the distance in working direction between the at least one drive butt and the bending portion, wherein the bending-portion clearance is at least as large as an extension length corresponding to the path of the needle in working direction between the retracted and extended states. In this way, the drive-butt area of the needle is always accommodated in a guiding groove and the driving forces acting on the drive butt are better supported. The area of the needle which borders directly on the drive butt is nevertheless exposed to high mechanical loads. The needle's bending portion is likewise an area which has to withstand high mechanical loads on account of the constant-during knitting also alternating-elastic bending. To avoid overlapping of these high loads in a transition area, it is accordingly advantageous if the drive butt is spaced sufficiently far away from the bending portion.

Further advantages are obtained if the working portion and the shank portion of the at least one needle extend substantially parallel to one another in working direction. If the working portion and the guiding portion run parallel to one another in working direction and the needle moves translatorially, the loop-forming element performs linear motion in working direction. If there were angular offset between the shank portion and the drive portion, this could lead to additional movement of the loop-forming element in peripheral direction. This would lead to knitting flaws and a non-uniform loop structure. Furthermore, the forces developing between the working portion of the needle and the verge groove would be greater, resulting in increased wear and power consumption. Mutual parallelism of the two portions is, in this context, an ideal. Manufacturing tolerances and play between the needle and the respective guiding and verge grooves almost always result in a small angular offset between the working portion and the shank portion. The expression "substantially parallel" means in this case that the working portion and the shank portion are parallel to the extent possible within the technical tolerance limits of routinely used manufacturing methods.

Also to advantage is a knitting system according to the invention, which has at least one guiding wall, which limits the at least one guiding groove in peripheral direction, and at least one additional bar, which adjoins the at least one guiding wall in working direction and is arranged on the base surface of the needle-guiding means, wherein for the width ratio (V) of the guiding-wall width ($b_{FS}$) to the additional-bar width ($b_{HS}$), $V=b_{FS}/b_{HS}$, the following applies: $2.0 \leq V \leq 2.5$, preferably $2.1 \leq V \leq 2.4$. The use of additional bars to support a sinker holder—in connection with a circular knitting machine cylinder this is also known as a sinker ring—in which sinker grooves for additional knitting tools involved in the knitting process, for example sinkers, are arranged, has been known for many years.

However, hitherto known additional bars generally have the same width in peripheral direction as the adjoining guiding wall. In the case of the knitting system according to the invention, the additional bars and the bending portion of the needles are located at the same height in working direction. In order to prevent collisions and friction between the bending portion of the needles and the additional bars, it is therefore advantageous to configure the additional bars to be narrower than the guiding walls—in particular bearing in mind the above-mentioned size ratios. In consequence of the concomitant avoidance of contact points, the power consumption of the whole knitting system decreases and there is less wear. It is not necessary for every guiding wall to have an adjoining additional bar in order to guarantee correct functioning. On the contrary, the number of additional bars may be fewer than the number of guiding walls.

Additional advantages are obtained if, between a working-portion centerline extending in the middle of the working portion along the tool's longitudinal direction and a shank-portion centerline extending in the middle of the shank portion along the tool's longitudinal direction, a shank offset S in peripheral direction exists, which is composed of a plastic shank offset $S_{PL}$ and an elastic shank offset $S_{EL}$ resulting from an elastic deformation—i.e. $S=S_{PL}+S_{EL}$, wherein, for the shank offset, as a function of a pitch t and the shank width $d_S$, the relation $S=(t-d_S)/2$ applies. In addition to a purely elastic bend and a purely plastic bend in order to compensate the shank offset between guiding groove and verge groove, it is advantageous to superimpose a plastic and an elastic bend in the bending portion.

On account of the plastic component of the bend, the proportion of the shank offset that has to be compensated with an elastic bend decreases and so, consequently, does the bending force and the component loading due to elastic deformation. This is advantageous particularly in the case of large pitches—i.e. large shank offsets.

It is advantageous if the shank portions of at least two needles are accommodated in one and the same guiding groove. Walls are required for the formation of guiding grooves. The transverse forces acting on the needle's drive butt are discharged onto these walls. If two or more needles are accommodated in the same guiding groove, the number of guiding grooves and consequently also guiding walls required for a given number of needles decreases—the installation space is accordingly better utilized. Consequently it is possible, without changing the size of a needle-guiding means in peripheral direction—e.g. in the case of a knitting cylinder, without increasing the circumference or the diameter of the cylinder—to operate a larger number of needles and obtain a finer pitch.

Also to advantage is a needle with the following features:

- a loop-forming element arranged at a first end, pointing in a positive working direction, of the needle,
- a shank portion, which is suitable to be accommodated in a guiding groove of a needle-guiding means and is arranged at a second end, pointing in the negative working direction, of the needle, a working portion, which incorporates the loop-forming element and is suitable to be accommodated in a verge groove of a needle-guiding means,
- a bending portion, which is interposed in working direction between the shank portion and the working portion, characterised in that, in the bending portion of the needle, at least one recess is arranged at at least one of its lateral surfaces pointing in peripheral or elevational direction, and/or the bending portion is plastically formed in such a manner as to effect, in a width direction, which is at right angles to the working direction, a plastic shank offset between the working portion and the shank portion. The plastic shank offset also exists in a state in which no external force is acting on the needle. In the case of needle-guiding means whose guiding and verge grooves are arranged in such a way that the needles have to compensate an offset between the working portion and the shank portion in peripheral direction, previously known needles are exposed to high elastic deformations. On account of the needle's plastic deformation, the elastic deformation as well as the force required for said elastic deformation is reduced in such a case.

It is advantageous if at least one recess at a lateral surface pointing in peripheral direction has a recess depth of 10 μm to 100 μm, advantageously 30 μm to 70 μm, and/or at least one recess at a lateral surface pointing in elevational direction has a recess depth of 150 μm to 500 μm, advantageously 200 μm to 400 μm. If the recess were too deep, the needle would be weakened too much in the bending portion. If, on the other hand, the recess is not deep enough, the stability of the needle in the shank portion and working portion cannot be sufficiently improved. The above-mentioned selection range has proved advantageous with customary needle widths of less than 0.6 mm because a positive effect is obtained with regard to stability and wear resistance in the shank and working portions but, at the same time, the needle is not weakened too much in the bending portion.

Further advantages are obtained if the at least one recess extends, in an elevational direction which is at right angles to the working direction and the width direction, over the entire needle height. A recess which extends over the entire needle height requires less complex production methods than a recess which only extends over part of the needle height.

However, a recess which extends in elevational direction over a maximum of 90%, preferably a maximum of 80%, of the needle height is also advantageous. It is particularly advantageous if the height of the recess in elevational direction—i.e. the recess height—is a maximum of 90%, preferably, however, a maximum of 80% of the needle height. The bending properties of the needle can also be specifically adapted to the knitting system with a recess which does not extend over the entire needle height. The extension of the recess in elevational direction relative to the needle height thus influences the rigidity and strength of the needle in the bending portion.

BRIEF DESCRIPTION OF THE DRAWINGS

It is also advantageous if the working portion and the shank portion extend substantially parallel to one another in working direction. During the knitting process, knitting-machine needles generally perform purely translatory motion in the needles' working direction. It is advantageous for a precise knitting movement if the working portion and the shank portion are mutually parallel.

DETAILED DESCRIPTION

Figure 1:
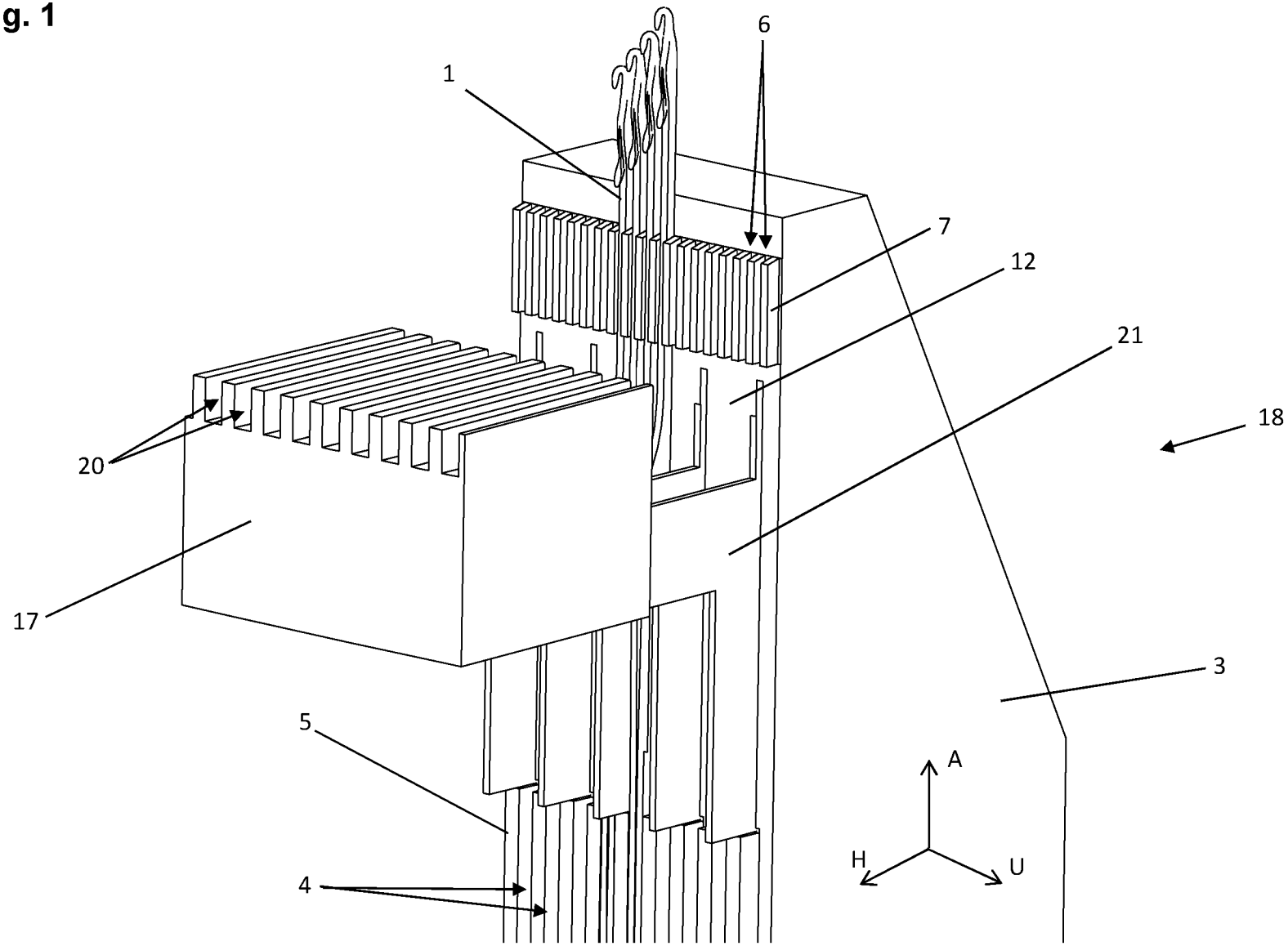
FIG. 1 shows part of a needle-guiding means 3 having guiding grooves 4 and verge grooves 6, additional bars 21, needles 1 and a sinker holder 17.

FIG. 1 shows a three-dimensional view of part of a needle-guiding means 3 having a plurality of guiding grooves 4, which are arranged on the base surface 12 of the needle-guiding means 3 and are spaced from each other in peripheral direction U by guiding walls 5. A plurality of verge grooves 6, which are offset relative to the guiding grooves 4 in working direction A and peripheral direction U, are arranged on the base surface 12 of the needle-guiding means 3 and are spaced from each other, in peripheral direction U, by verge walls 7. An additional bar 21 adjoins every second guiding wall 5 in working direction A. The additional bars 21 support a sinker holder 17, which is suitable for guiding sinkers in sinker grooves 20 running in elevational direction H. In connection with needle-guiding means 3 in the form of knitting cylinders, sinker holders 17 are also known as sinker rings on account of their circular shape. A plurality of needles 1 is arranged in the guiding grooves 4 and verge grooves 6, with two needles 1 always being arranged together in one guiding groove 4 and each needle 1 always being arranged singly in a verge groove 6.

Figure 2:
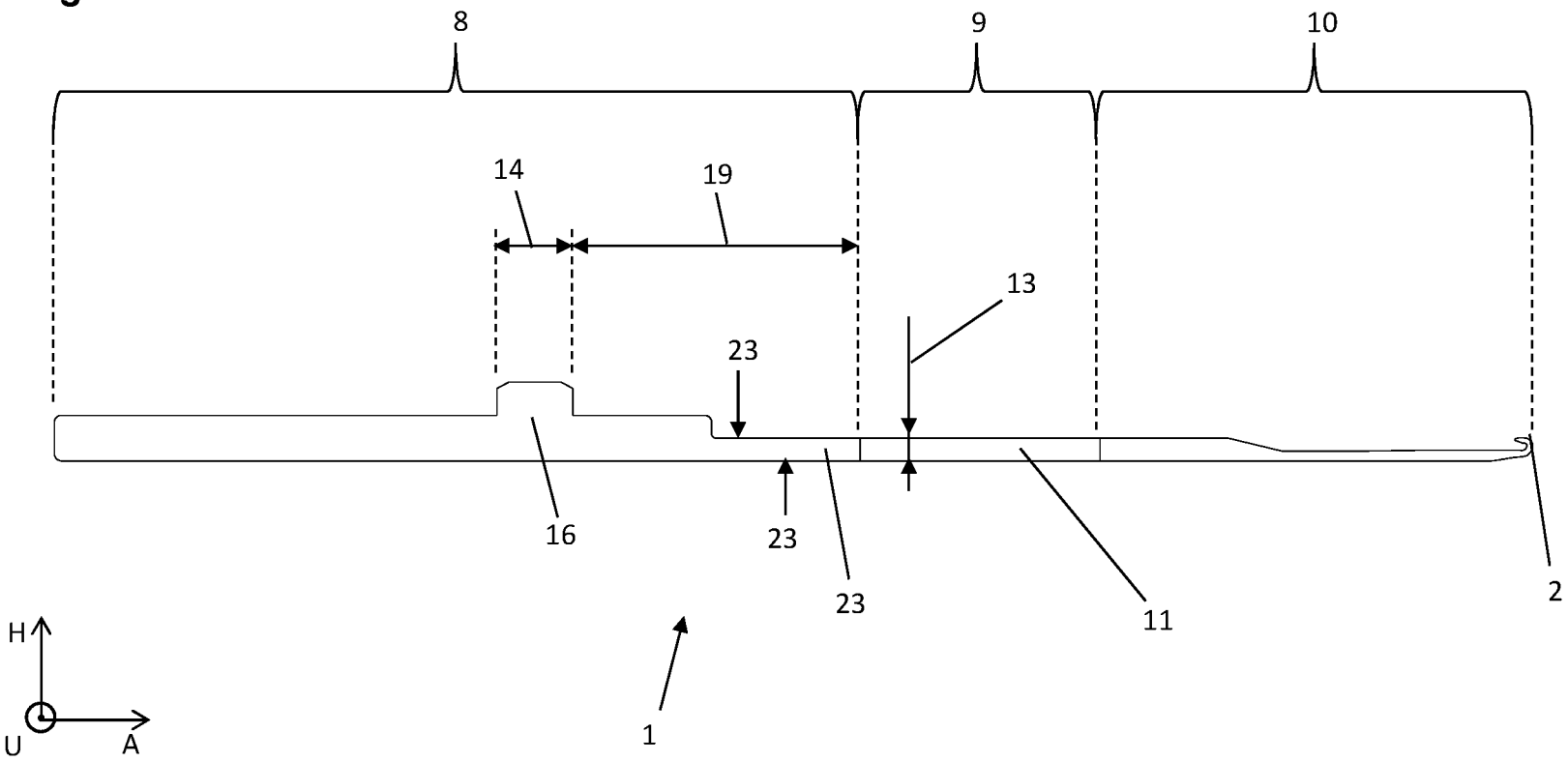
FIG. 2 shows a side view of a needle 1.

FIG. 2 shows a side view of a needle 1, which has, at its front end pointing in working direction A, a working portion 10 incorporating a loop-building element 2 in the shape of a hook. The working portion 10 is suitable to be accommodated in a verge groove 6 of a needle-guiding means 3. At its other end, pointing away from the loop-forming element 2, the needle 1 comprises a shank portion 8, which is suitable to be accommodated in a guiding groove 4 of a needle-guiding means 3. A bending portion 9 is interposed between the shank portion 8 and the working portion 10. The needle height 13 is the height, in elevational direction H, of the needle 1 in the bending portion 9. The needle 1 is bounded in peripheral direction U and elevational direction H by the lateral surfaces 23. In the bending portion 9, a recess 11 is defined on the lateral surface 23 pointing in peripheral direction U and extends, in working direction A, over the entire length of the bending portion 9 and, in elevational direction H, over the entire needle height 13. A drive butt 16 is arranged in the shank portion 8, the distance between the drive butt 16 and the bending portion 9—i.e. the bending-portion clearance 19—being greater than the drive-butt length 14. The drive butt 16 projects from a surrounding portion of the shank portion 8 in an elevational direction H orthogonal to the working direction A and the peripheral direction U. When the needle 1 is in operation, it is actuated to perform translatory motion in working direction A by the introduction of force at the drive butt 16. In the bending portion 9, the needle is able to deform elastically and/or is plastically formed, so that the working portion 10 and the shank portion 8 are mutually offset in peripheral direction U. From an ideal point of view, the working portion 10 and the shank portion 8 are always aligned exactly parallel in working direction. The shank portion 8 comprises a lower lateral surface 23 and an upper lateral surface 23 each extending between opposing lateral side surfaces of the shank portion 8, and the lower lateral surface 23 extends in the working direction along a constant elevation between the drive butt 16 and the bending portion 9, and a height dimension of the shank portion 8 measured in the elevational direction H between the lower lateral surface 23 and the upper lateral surface 23 decreases between the drive butt 16 and the bending portion 9 along the working direction A.

Figure 3:
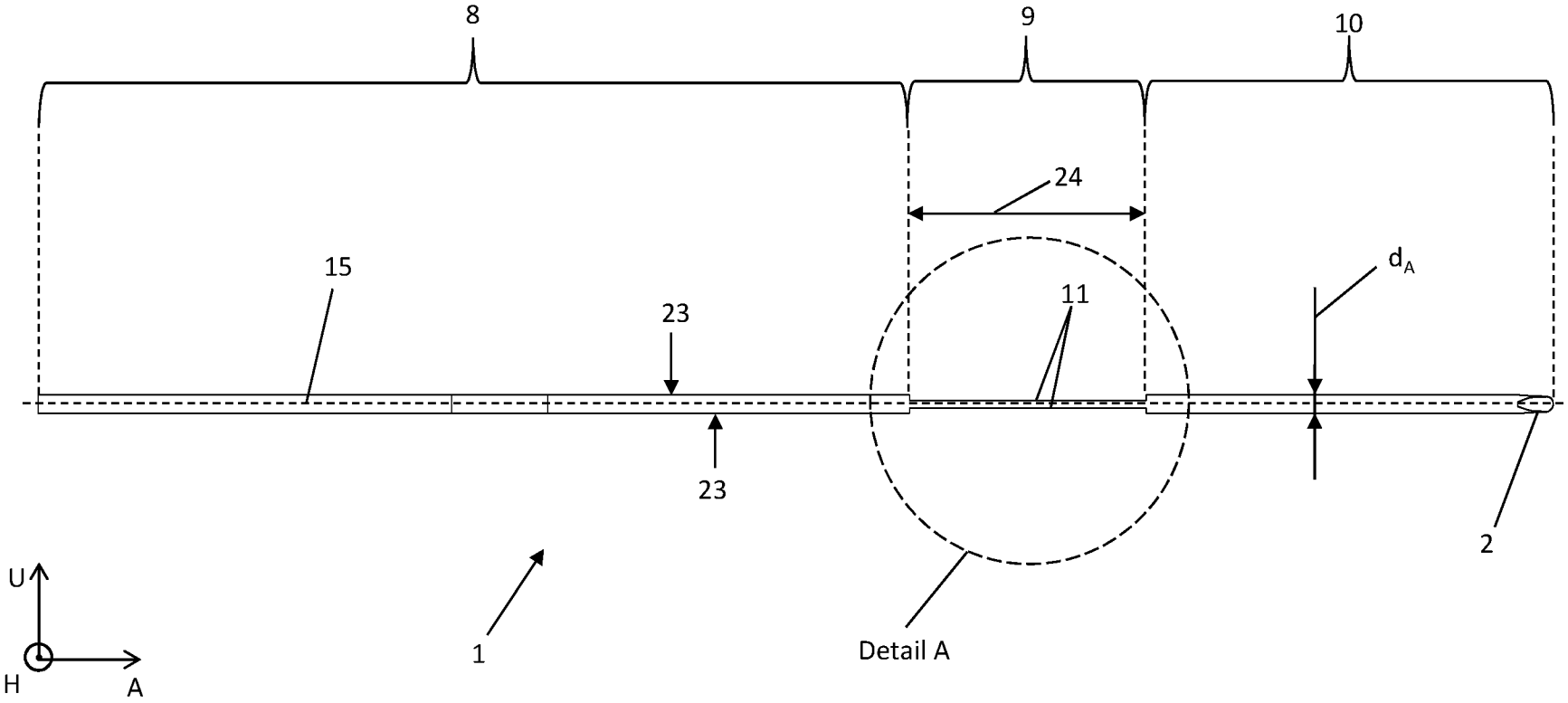
FIG. 3 shows a top view of a needle 1 that is neither plastically nor elastically formed in the bending portion 9.

FIG. 3 shows a top view of the needle 1 of FIG. 2, which is neither plastically nor elastically formed in the bending portion 9. The sub-division into a shank portion 8, a bending portion 9 and a working portion 10 corresponds to that of FIG. 2. The shank portion 8, the bending portion 9 and the working portion 10 lie exactly on a centerline 15 without any mutual offset in peripheral direction U. At its front end, in working direction A, the needle 1 has a loop-forming element 2 shaped as a hook. In the bending portion 9, recesses 11 are defined on both lateral surfaces 23 pointing in peripheral direction U. However, a needle 1 whose bending portion 9 only has a recess 11 defined on one lateral surface 23 pointing in peripheral direction U or elevational direction H is also advantageous for all embodiments of the knitting system. FIG. 3 also indicates the position of the detail A, which is shown enlarged in FIG. 4.

Figure 4:
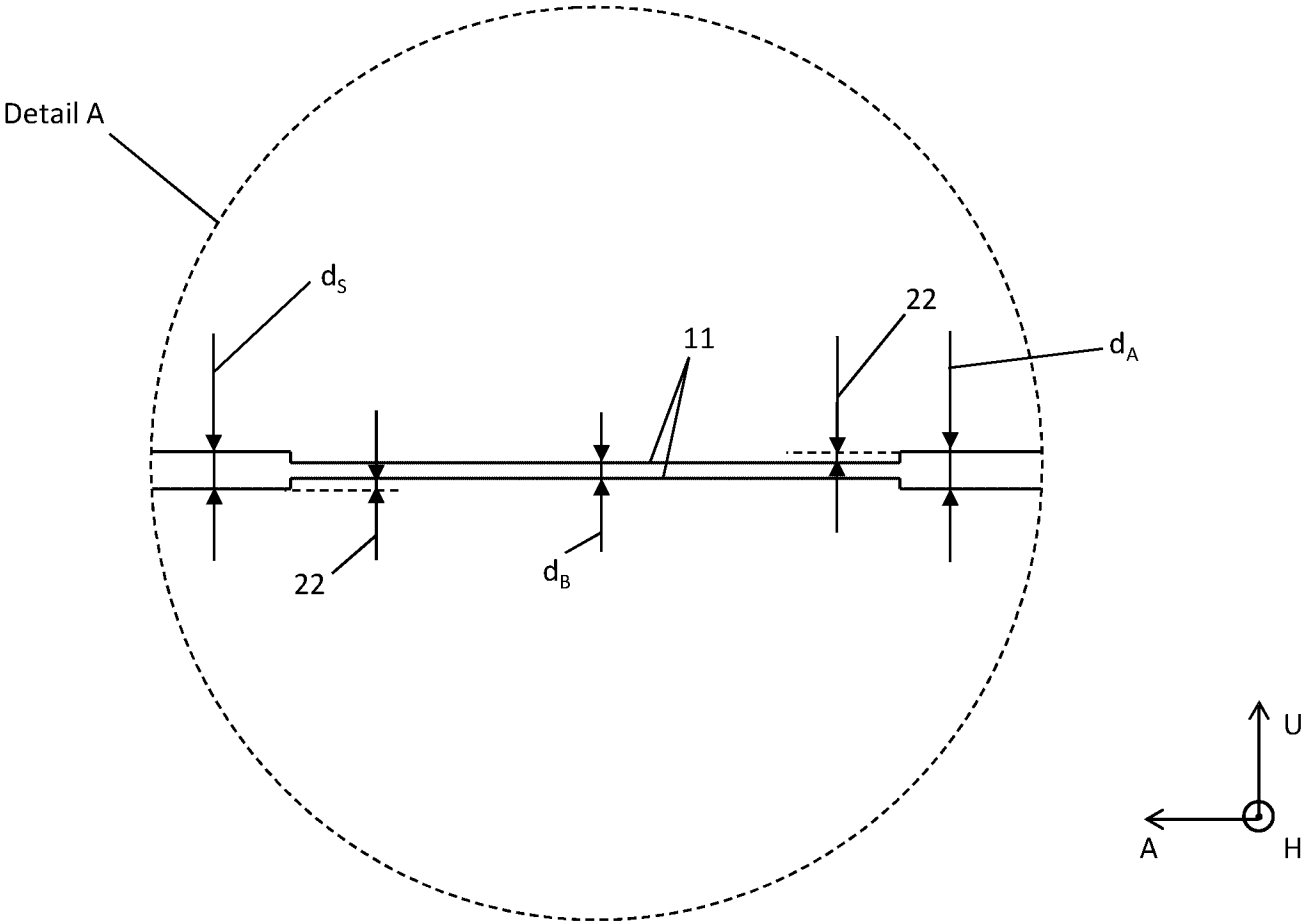
FIG. 4 shows the detail A of FIG. 3 in enlarged form.

FIG. 4 shows the detail A of FIG. 3. Each of the two recesses 11 reduces the width, in peripheral direction U, of the needle 1 in the bending portion 9—i.e the bending-portion width $d_B$—by the recess depth 22 compared to the shank-portion width $d_S$ and the working-portion width da. The recess depth 22 is constant along a majority of a length of the recess and is within the aforementioned selection range. In order to show the recess 11 more clearly, the recess depth 22 is not to scale in the drawing but is enlarged compared to the other components of the needle.

Figure 5:
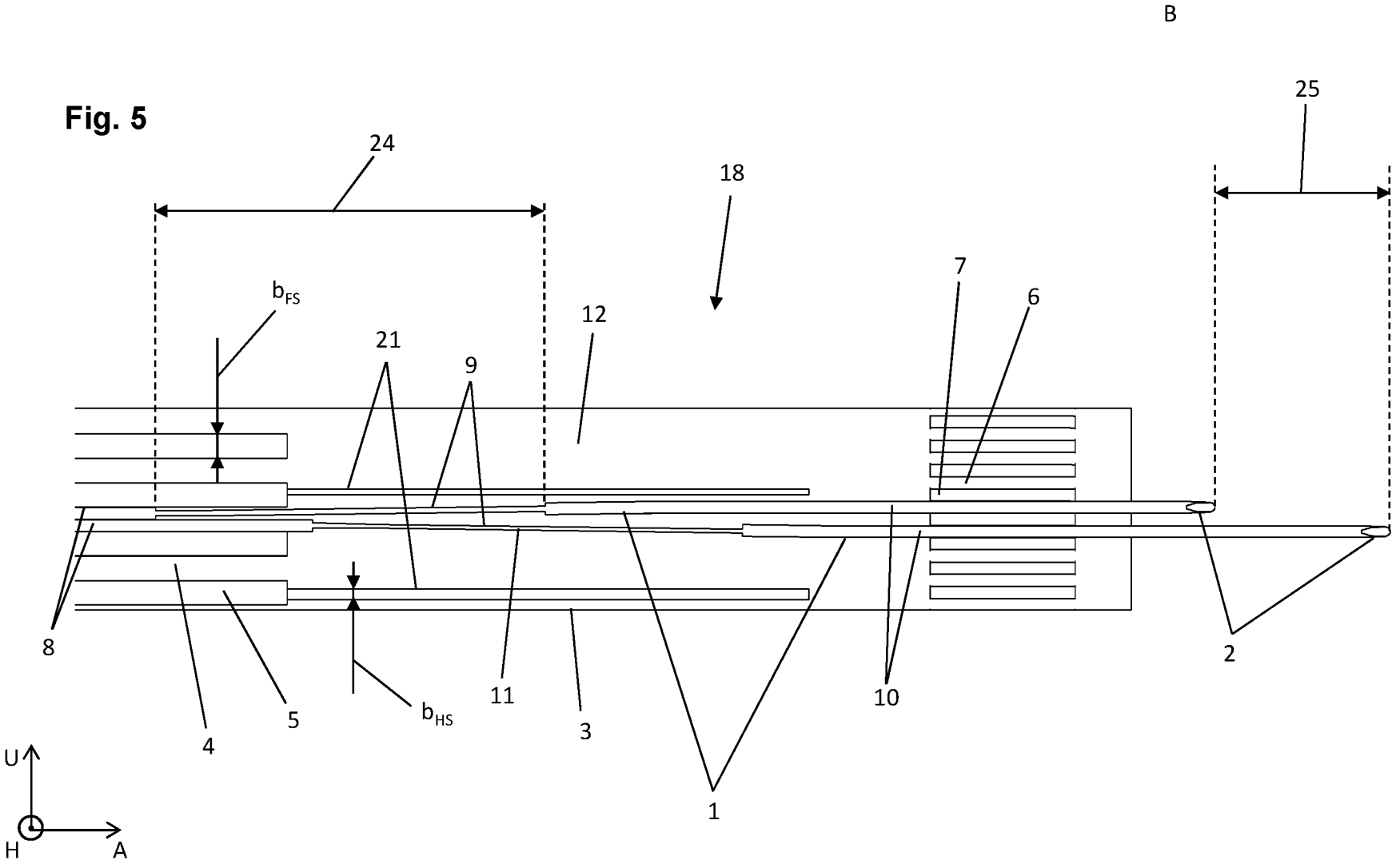
FIG. 5 Shows a top view of the base surface 12 of a needle-guiding means 3 having guiding grooves 4 and verge grooves 6, additional bars 21, as well as one needle in the extended and one in the retracted state.

FIG. 5 shows the top view of a section of the base surface 12 of the needle-guiding means 3. The needle-guiding means may be a knitting cylinder for circular knitting machines or a needle bed for flat knitting machines. The relevant features of FIG. 5 may be assigned to both variants of a needle-guiding means 3. At the left-hand end of the drawing, a plurality of guiding grooves 4 is shown, in one of which two needles 1 are accommodated—i.e. the shank portions 8 of the needles 1 are arranged beside each other in a guiding groove 4. The working portions 10 of the two needles 1 are each arranged in a verge groove 6. A plurality of guiding grooves 4 is shown, which are spaced from each other by guiding walls 5. A plurality of verge grooves 6 is shown as well, which are spaced from each other by verge walls 7. For reasons of clarity, only one guiding groove 4, one verge groove 6, one guiding wall 5 and one verge wall 7 are provided with a reference numeral. The lower needle 1 in FIG. 5 is shown in an extended state, with the loop-forming element 2 protruding out of the verge groove 6 by the maximum amount. By contrast, the upper of the two needles 1 in FIG. 5 is shown in a retracted state, with the loop-forming element 2 protruding out of the verge groove 6 by the minimum amount. In the extended state, the needle 1 is displaced relative to its position in the retracted state by the extension length 25 in working direction A. In the extended state (lower needle), the recesses 11 of the lower needle 1 are completely outside of the guiding grooves 4 and the verge grooves 6. As this is the end position during translatory motion in positive working direction A, the recesses 11 do not reach into the verge grooves 6 in any other position either while the needle is moving. In this way, the introduction of dirt into the verge grooves is reduced. In the retracted state (upper needle 1), the recesses 11 of the upper needle 1 are completely outside of the verge grooves 6 and to an extent of two thirds of the recess length 24 outside of the guiding grooves 4. As this is the end position during translatory motion in the negative working direction A, there is no other position at which, while the needle is moving, the recesses 11 are outside of the guiding grooves 6 by less than two thirds of the recess length 24. In FIG. 5, two guiding walls 5 are each adjoined by an additional wall 21. The additional-wall width brs bus of both additional walls 21 is less than the guiding-wall width brs. The needles 1 are thereby prevented from touching the additional bar 21 in their bending portion 9 in cases of excessive deformation. Advantageous selection ranges for the size ratio between guiding-wall width brs and additional-bar width $b_{HS}$ have been specified here earlier on. In this embodiment, the two additional bars 21 have different additional-bar widths $b_{HS}$. It is also advantageous if at least two—preferably all—additional bars 21 have the same additional-bar width $b_{HS}$.

Figure 6:
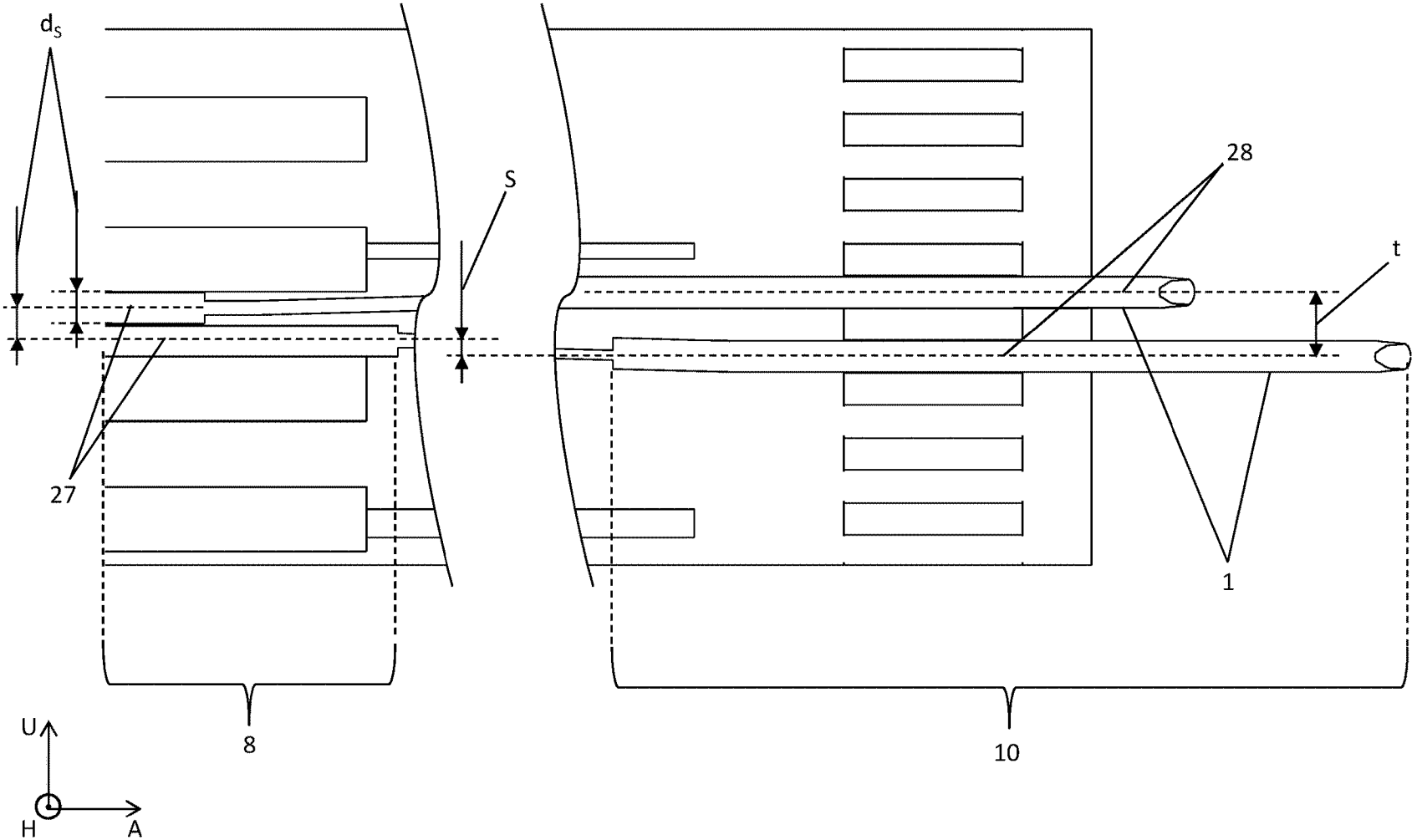
FIG. 6 shows, in enlarged details from FIG. 5, the pitch t, the shank offset S and the distance between the two shank-portion centerlines 27, which corresponds to the shank width $d_S$.

FIG. 6 shows enlarged details from FIG. 5. A shank offset S exists in peripheral direction U between the respective shank-portion centerline 27 of the shank portion 8 and the working-portion centerline 28 of the working portion 10 of the needles 1. The distance between the shank-portion centerlines 27 of adjacent needles 1 corresponds to the shank width $d_S$. The pitch t is the distance in peripheral direction between the working-portion centerlines 28 of adjacent needles 1. For the shank offset S, as a function of the shank width $d_S$ and the pitch t, the following formula applies: $S=(t-d_S)/2$.

Figure 7:
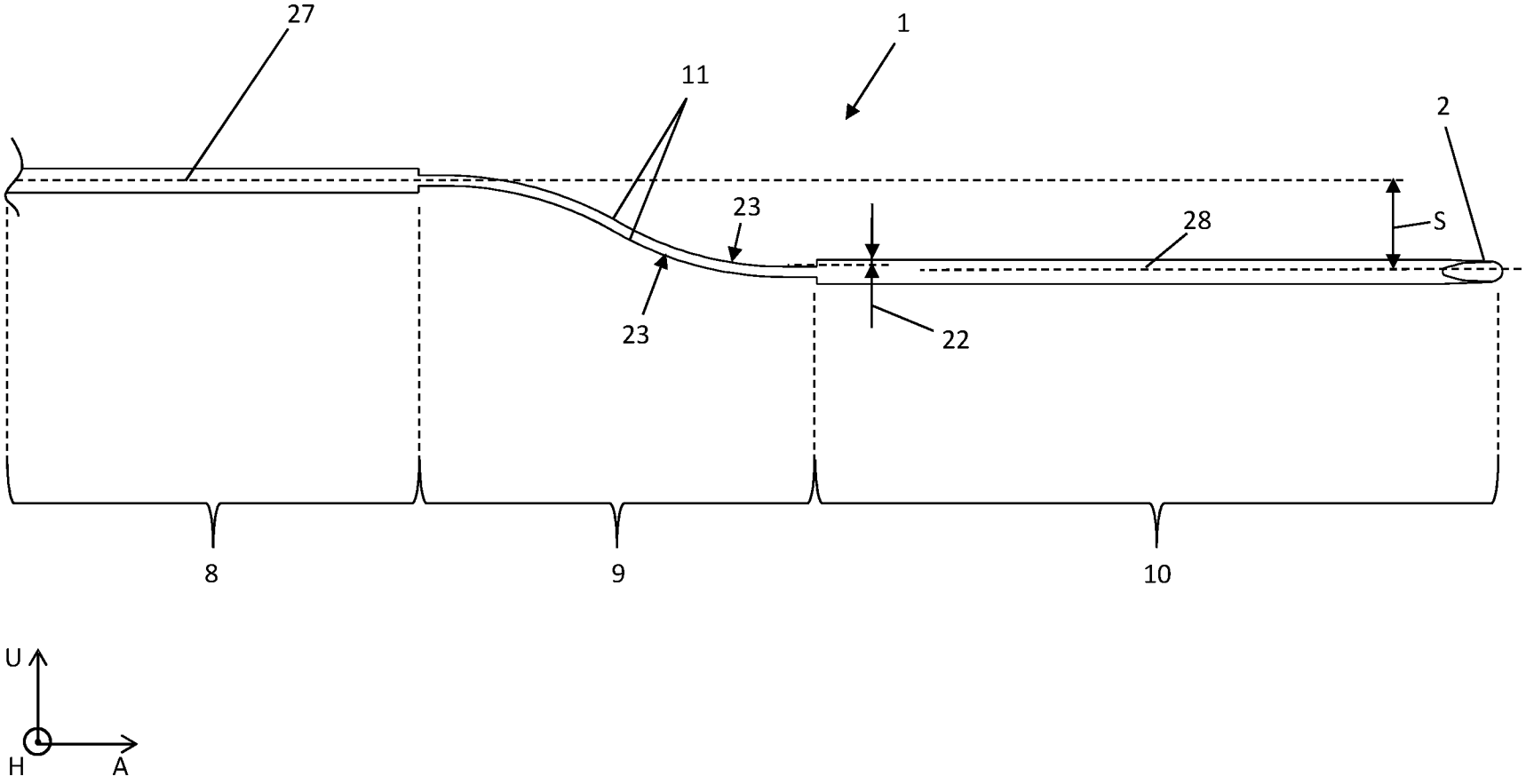
FIG. 7 shows a loop-forming needle 1 which is plastically formed in the bending portion 9.

FIG. 7 shows a top view of the needle 1, which, in the bending portion 9, is formed in such a way that a shank offset S exists between the working-portion centerline 28 of the working portion 10 and the shank-portion centerline 27 of the shank portion 8. The deformation may be a plastic and/or an elastic deformation. Whereas the shank offset S does not change during translatory motion of the needle 1 in working direction A in a needle-guiding means 3, the shape of the deformation is not constant but changes according to the deflection of the needle 1. In the bending portion 9, recesses 11 are defined on both the lateral surfaces 23 pointing in peripheral direction U. These recesses 11 reduce the width of the needle 1 in peripheral direction U in the bending portion 9. A needle 1 with a recess 11 on only one lateral surface 23 in the bending portion 9 is also advantageous. The recess depth 22 of the recesses 11 on the lateral surfaces 23 pointing in peripheral direction U is within the aforementioned selection range of 10 μm to 100 μm, more advantageously 30 μm to 70 μm. In FIG. 7 the recess depth 22 and the shank offset S are not drawn to scale but are enlarged in order to show them more clearly.

Figure 8:
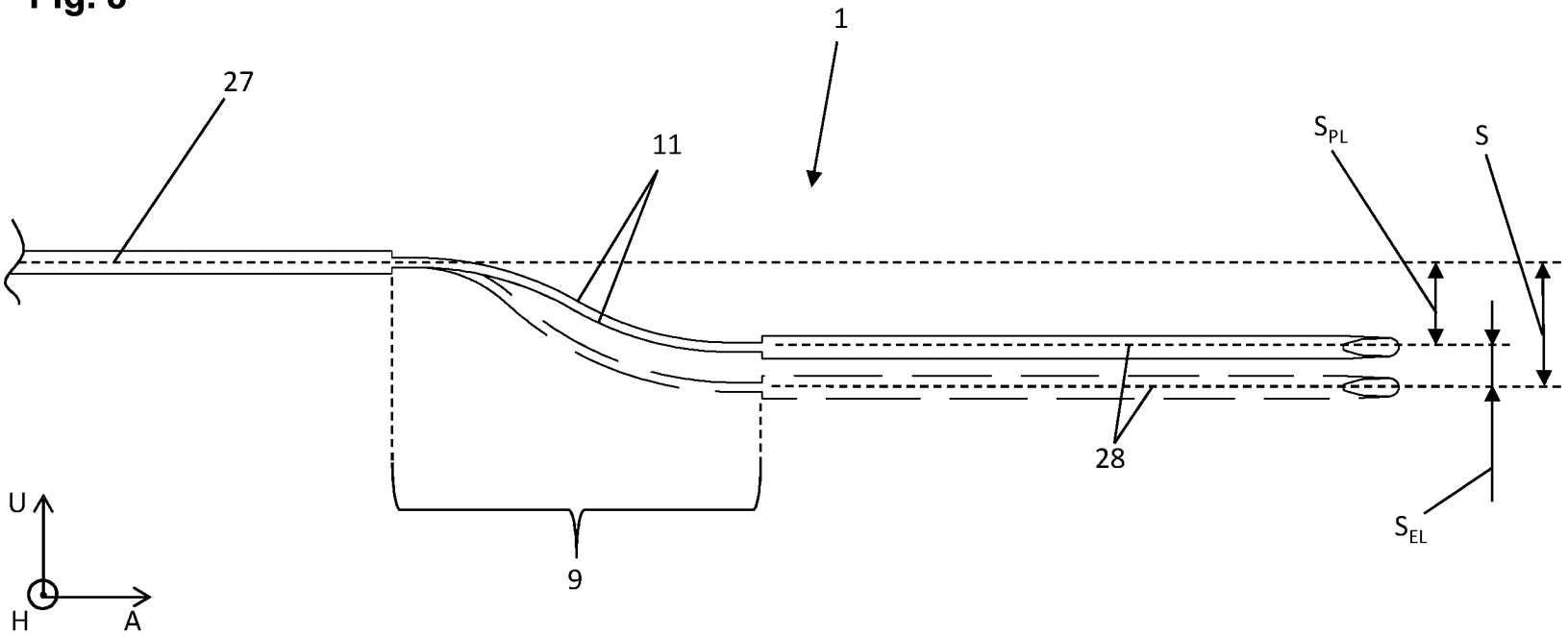
FIG. 8 shows a needle 1 which is plastically formed in the bending portion 9 as well as, superimposed thereupon, a state in which the loop-forming needle 1 is plastically and elastically formed.

FIG. 8 shows the needle 1 of FIG. 5. The shank offset S between the shank-portion centerline 27 and the working-portion centerline 28 is composed of a plastic shank offset $S_{PL}$ and an elastic shank offset $S_{EL}$. The contour of the needle 1 in the state with exclusively plastic deformation (without elastic deformation) is shown here with continuous lines. The contour of the needle 1 in the state with plastic deformation and superimposed elastic deformation is shown with broken lines. The recess 11 and the shank offset S are not drawn to scale but are enlarged compared to the rest of the drawing in order to show them more clearly.

Figure 9:
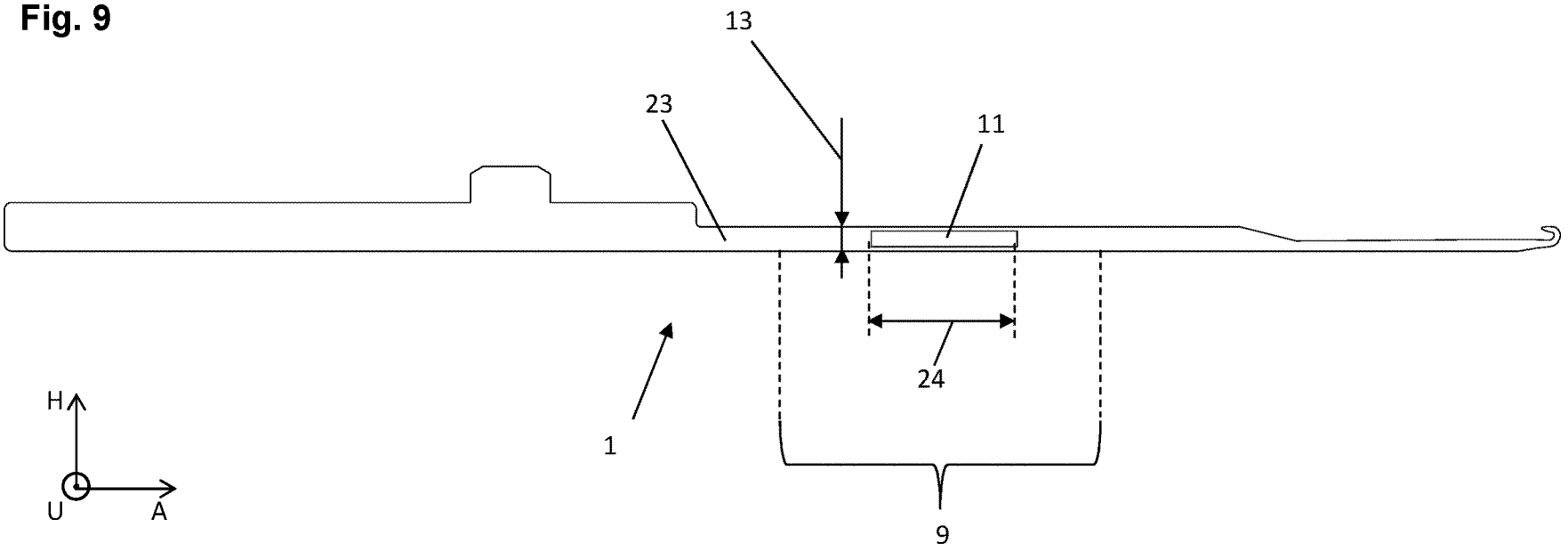
FIG. 9 shows a needle 1 having a recess 11, which extends, in the elevational direction H, over less than 80% of the needle height 13.

FIG. 9 shows a side view of a needle 1. On its lateral surface 23 pointing in peripheral direction U, the needle 1 has a recess 11 which extends in elevational direction H over less than 80% of the needle height 13. On the other lateral surface 23 pointing in peripheral direction U, which is not visible in this drawing, the needle 1 has a second recess 11. The recess length 24, in working direction A, of the recess 11 is less than 50% of the length of the bending portion 9 in working direction A. However, it is also advantageous if the recess length 24 is up to 100% or less than 50% of the length of the bending portion 9.

Figure 10:
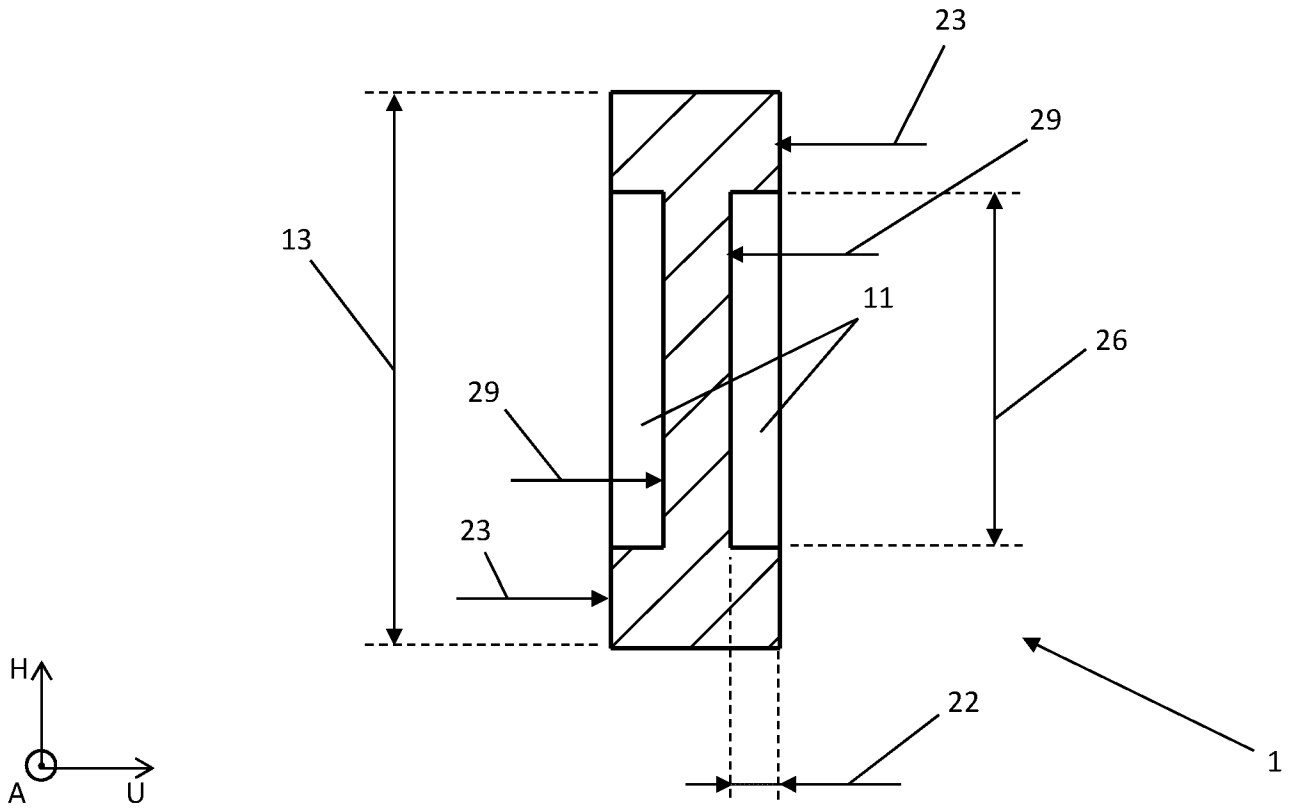
FIG. 10 shows a section in the H-U plane through the needle 1 of FIG. 9 at the position of the recess 11.

FIG. 10 shows a section in the H-U plane through the needle 1 of FIG. 9 at the location of the recesses 11. The recess surfaces 29 point in peripheral direction U and each of them is stepped relative to the lateral surfaces 23 pointing in peripheral direction U by the recess depth 22; i.e. each of the recesses 11 reduces the bending-portion width de in peripheral direction U by the recess depth 22. The recess height 26 in elevational direction H is less than 80% of the needle height 13. This feature can be combined advantageously with every embodiment of the knitting system 18 and of the needle 1.

Figure 11:
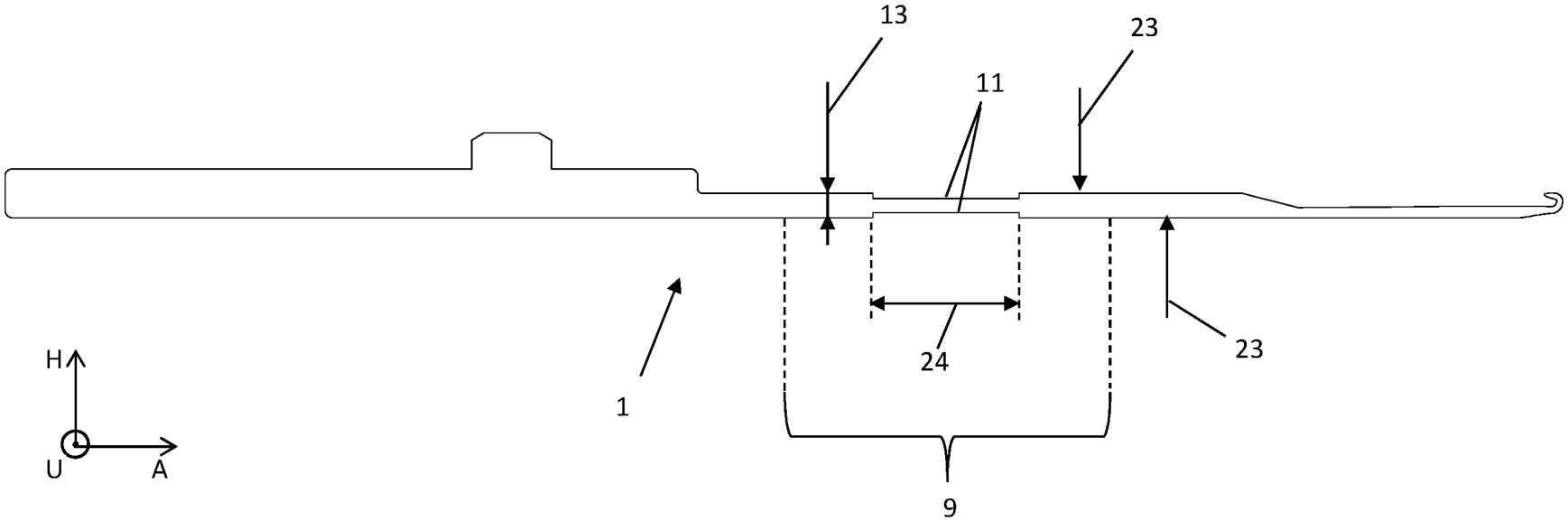
FIG. 11 shows a needle 1 having two recesses 11, which are disposed on a lateral surface 23 pointing in the elevational direction H.

FIG. 11 shows a side view of a needle 1. On each of its two lateral surfaces 23 pointing in elevational direction H, the needle 1 has a recess 11 which extends in peripheral direction U over the entire width of the bending portion 9. The recess depth 22 of the recesses 11 on the lateral surfaces 23 pointing in elevational direction H is within the aforementioned selection range of 150 μm to 500 μm, more advantageously 200 μm to 400 μm. The recess length 24, in working direction A, of the two recesses 11 is less than 50% of the length of the bending portion 9 in working direction A. For all embodiments of the knitting system 18 and of the needle 1 it is also conceivable, however, that the recess length 24 is up to 100% or less than 50% of the length of the bending portion 9.

Figure 12:
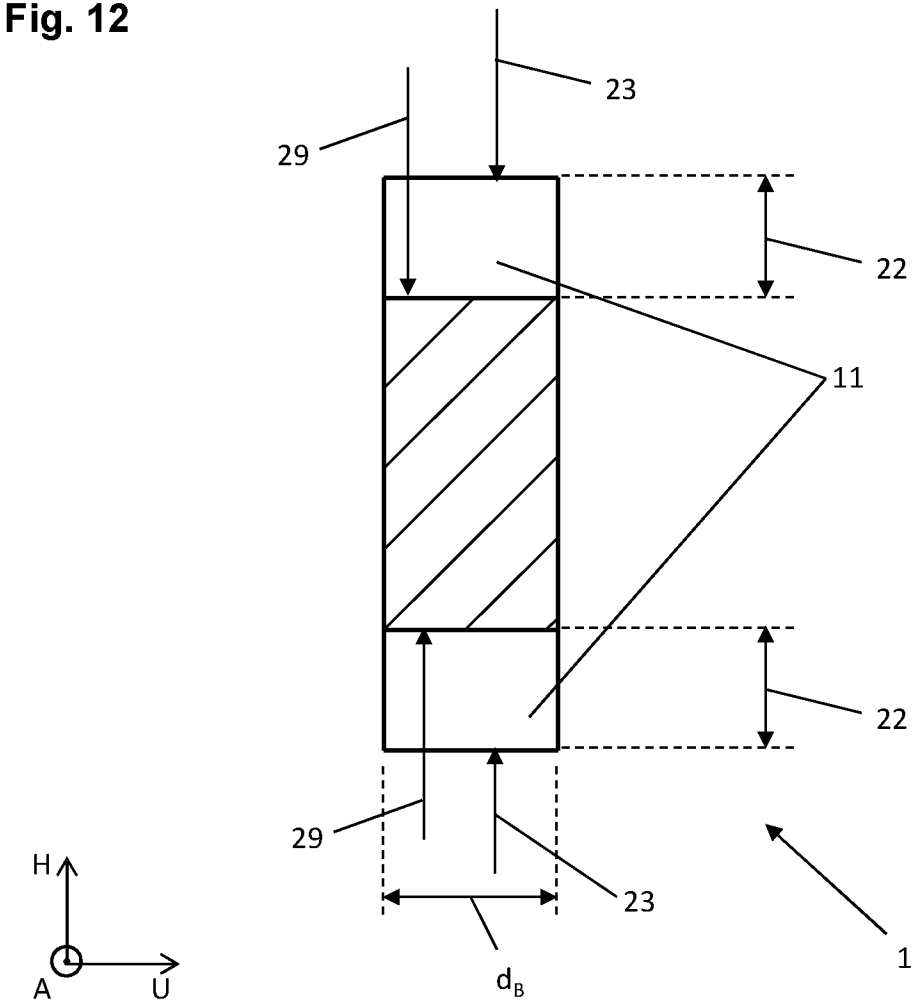
FIG. 12 shows a section in the H-U plane through the needle 1 of FIG. 11 at the position of the recesses 11.

FIG. 12 shows a section in the H-U plane through the needle 1 of FIG. 11 at the location of the recesses 11. The recesses 11 extend over the entire bending-portion width $d_B$. The recess surfaces 29 point in elevational direction H and are stepped relative to the lateral surfaces 23 pointing in elevational direction H by the recess depth 22, so that each of the recesses 11 reduces the cross-section of the bending portion in elevational direction H by the recess depth 22.

List of reference numerals

| | |
|---|---|
| 1 | Needle |
| 2 | Loop-forming element |
| 3 | Needle-guiding means |
| 4 | Guiding groove |
| 5 | Guiding wall |
| 6 | Verge groove |
| 7 | Verge wall |
| 8 | Shank portion |
| 9 | Bending portion |
| 10 | Working portion |
| 11 | Recess |
| 12 | Base area of the needle-guiding means 3 |
| 13 | Needle height |
| 14 | Length of drive butt |
| 15 | Centerline |
| 16 | Drive butt |
| 17 | Sinker holder |
| 18 | Knitting system |
| 19 | Distance between drive butt 16 and bending portion 9 |
| 20 | Sinker groove |
| 21 | Additional bar |
| 22 | Depth of recess |
| 23 | Lateral surface |
| 24 | Length of recess |
| 25 | Extension length |
| 26 | Height of recess |
| 27 | Shank-portion centerline |
| 28 | Working-portion centerline |
| 29 | Surface of recess |
| S | Shank offset |
| $S_{PL}$ | Plastic shank offset |
| $S_{EL}$ | Elastic shank offset |
| t | Pitch |
| $b_{HS}$ | Additional bar width |
| $b_{FS}$ | Guiding wall width |
| $d_A$ | Working-portion width of working portion 10 |
| $d_B$ | Bending-portion width of bending portion 9 |
| $d_S$ | Shank width of shank portion 8 |
| A | Working direction |
| H | Elevational direction |
| U | Peripheral direction |

The invention claimed is:

1. A knitting needle (1) comprising:

a loop-forming element (2) arranged at a first end of the knitting needle (1), said first end pointing in a working direction (A), a shank portion (8), which is configured to be accommodated in a guiding groove (4) of a needle-guiding means (3), and is arranged at a second end of the knitting needle (1), said second end pointing in a direction opposite from the working direction, a working portion (10), which includes the loop-forming element (2) and which is configured to be accommodated in a verge groove (6) of the needle-guiding means (3), wherein the verge groove (6) is offset from the guiding groove (4) in the working direction and a peripheral direction (U) that is orthogonal to the working direction, a drive butt (16) of the shank portion (8) projecting from a surrounding portion of the shank portion in an elevational direction (H) orthogonal to the working direction and the peripheral direction, a bending portion (9), which is positioned in the working direction (A) between the shank portion (8) and the working portion (10), wherein in the bending portion (9) of the knitting needle (1), at least one recess (11) is arranged at at least one lateral surface (23) of the bending portion (9), wherein the at least one recess (11) either:

points in the peripheral direction (U) and has a constant recess depth (22) of 10 μm to 100 μm along a majority of a length of the at least one recess, or points in the elevational direction (H) and has a constant recess depth (22) of 150 μm to 500 μm along a majority of a length of the at least one recess, wherein the shank portion (8) comprises a lower lateral surface and an upper lateral surface each extending between opposing lateral side surfaces of the shank portion, wherein the lower lateral surface extends in the working direction along a constant elevation between the drive butt (16) and the bending portion (9), and wherein a height dimension of the shank portion (8) measured in the elevational direction (H) between the lower lateral surface and the upper lateral surface decreases between the drive butt (16) and the bending portion (9) along the working direction.

2. The knitting needle (1) according to claim 1, wherein the at least one recess (11) points in the peripheral direction (U) and extends in the elevational direction (H) along an entire height (13) of the knitting needle at the bending portion (9).

3. The knitting needle (1) according to claim 1, wherein the at least one recess (11) points in the peripheral direction (U) and extends in the elevational direction (H) along a maximum of 90% of a height (13) of the knitting needle measured at the bending portion (9).

4. The knitting needle (1) according to claim 1, wherein the working portion (10) and the shank portion (8) extend substantially parallel to one another in the working direction (A).

5. The knitting needle (1) according to claim 1, wherein the bending portion (9) is plastically formed in such a manner as to effect, in the peripheral direction (U), a plastic shank offset ($S_{PL}$) between the working portion (10) and the shank portion (8).

6. A knitting system (18) comprising:

at least one needle-guiding means (3), which has a base surface (12) pointing in an elevational direction (H), at least one guiding groove (4), which is arranged on the base surface (12) of the at least one needle-guiding means (3) and which extends substantially in a working direction (A), wherein said working direction (A) is orthogonal to the elevational direction (H), at least one verge groove (6), which is arranged on the base surface (12) of the at least one needle-guiding means (3) and is offset relative to the at least one guiding groove (4) in a peripheral direction (U) and the working direction (A), wherein said peripheral direction (U) is orthogonal to the working direction (A) and the elevational direction (H), at least one knitting needle (1) comprising, at a first end, which points in the working direction (A), a working portion (10) including a loop-forming element (2), and, at a second end, which points in a direction opposite from the working direction (A), a shank portion (8), a drive butt (16) of the shank portion (8) projecting from a surrounding portion of the shank portion in the elevational direction, wherein, between said shank portion (8) and said working portion (10), a bending portion (9) is positioned in which the at least one knitting needle (1) has a bend with directional components in the peripheral direction (U) and the working direction (A), wherein the working portion (10) of the at least one knitting needle (1) is accommodated in the at least one verge groove (6) and the shank portion (8) of the at least one knitting needle (1) is accommodated in the at least one guiding groove (4), wherein the shank portion (8) comprises a lower lateral surface and an upper lateral surface each extending between opposing lateral side surfaces of the shank portion, wherein the lower lateral surface extends in the working direction along a constant elevation between the drive butt (16) and the bending portion (9), wherein a height dimension of the shank portion (8) measured in the elevational direction (H) between the lower lateral surface and the upper lateral surface decreases between the drive butt (16) and the bending portion (9) along the working direction, wherein in the bending portion (9) of the at least one knitting needle (1), at least one recess (11) is arranged at at least one lateral surface (23) of the bending portion (9), wherein the at least one recess (11) either:

points in the peripheral direction (U) and has a constant recess depth (22) of 10 μm to 100 μm along a majority of a length of the at least one recess, or points in the elevational direction (H), and has a constant recess depth (22) of 150 μm to 500 μm along a majority of a length of the at least one recess.

7. The knitting system (18) according to claim 6, wherein the at least one recess (11) points in the peripheral direction (U) and extends in the elevational direction (H) along an entire height (13) of the at least one knitting needle at the bending portion (9).

8. The knitting system (18) according to claim 6, wherein:

the at least one recess (11) is completely outside of the at least one verge groove (6) and/or the at least one guiding groove (4) when the at least one knitting needle (1) is in an extended state and/or a retracted state.

9. The knitting system (18) according to claim 6, wherein the at least one recess (11) of the at least one knitting needle (1) in a retracted state is outside of the at least one guiding groove (4) to an extent of at least 60% of a recess length (24), which corresponds to an extension of the at least one recess (11) in the working direction (A), and the at least one recess (11) of the at least one knitting needle (1) in an extended state is outside of the at least one verge groove (6) to an extent of at least 60% of the recess length (24).

10. The knitting system (18) according to claim 6, further comprising a bending-portion clearance (19), which corresponds to a distance in the working direction (A) between the drive butt (16) and the bending portion (9), wherein said bending-portion clearance (19) is at least as large as an extension length (25) corresponding to a path of the at least one knitting needle (1) in the working direction (A) between a retracted state and an extended state.

11. The knitting system (18) according to claim 6, wherein the working portion (10) and the shank portion (8) of the at least one knitting needle (1) extend substantially parallel to one another in the working direction (A).

12. The knitting system (18) according to claim 6, further comprising at least one guiding wall (5), which limits the at least one guiding groove (4) in the peripheral direction (U), and at least one additional bar (21), which adjoins the at least one guiding wall (5) in the working direction (A) and is arranged on the base surface of the at least one needle-guiding means (3), wherein, a width ratio (V) of a width of the at least one guiding wall ($b_{FS}$) with respect to a width of the at least one additional bar ($b_{HS}$) ranges from 2.0 to 2.5.

13. The knitting system (18) according to claim 6, wherein the at least one knitting needle (1) comprises two knitting needles (1);

wherein the at least one verge groove (6) comprises two verge grooves (6);

wherein the shank portions (8) of the two knitting needles (1) are adjacently accommodated in the at least one guiding groove (4) without a gap therebetween;

wherein the working portions (10) of the two knitting needles (1) are each accommodated in a different verge groove (6) of the two verge grooves (6);

wherein each of the two knitting needles comprises a shank offset(S) in the peripheral direction (U) measured between a working-portion centerline (28) extending through a middle of the working portion (10) along a longitudinal direction (z) of each of the two knitting needles and a shank-portion centerline (27) extending through a middle of the shank portion (8) along the longitudinal direction (z) of each of the two knitting needles, wherein the shank offset(S) comprises a plastic shank offset ($S_{PL}$) and an elastic shank offset ($S_{EL}$) resulting from an elastic deformation, wherein the shank offset is a sum of the plastic shank offset and the elastic shank offset and the shank offset(S), as a function of a pitch (t) and a shank width ($d_S$), a relation $S=(t-d_S)/2$ applies, wherein the pitch (t) is a distance in the peripheral direction (U) between the working-portion centerlines (28) of the two knitting needles.

14. The knitting system (18) according to claim 6, wherein the bending portion (9) of the at least one knitting needle (1) is plastically formed in such a manner as to effect, in the peripheral direction (U), a plastic shank offset ($S_{PL}$) between the working portion (10) and the shank portion (8).

15. The knitting needle according to claim 1, further comprising an additional recess (11), wherein the additional recess (11) is formed in a lateral surface (23) opposite from the at least one recess (11) and either:

points in the peripheral direction (U) and has a constant recess depth (22) of 10 μm to 100 μm along a majority of a length of the additional recess, or points in the elevational direction (H) and has a constant recess depth (22) of 150 μm to 500 μm along a majority of a length of the additional recess.

* * * * *